US005531452A

United States Patent [19]

Gigante

[11] Patent Number: 5,531,452

[45] Date of Patent: Jul. 2, 1996

[54] SPORTS INSTALLATION FOR THE PRACTICE OF A GAME KNOWN AS HIT BALL

[76] Inventor: Luigi Gigante, Via Piedicavallo 37, I-10145 Turin, Italy

[21] Appl. No.: 385,116

[22] Filed: Feb. 7, 1995

[30] Foreign Application Priority Data

Feb. 7, 1994 [IT] Italy ..... TO94U0018 U

[51] Int. Cl.[6] ..... A63B 71/02

[52] U.S. Cl. ..... 273/411; 472/136

[58] Field of Search ..... 273/411; 472/136

[56] References Cited

U.S. PATENT DOCUMENTS 5,312,109 5/1994 Cagle ..... 273/411

*Primary Examiner*—William H. Grieb

*Attorney, Agent, or Firm*—Edward D. Manzo; Ted K. Ringsred

[57] ABSTRACT

A sports installation is in the form of a rectangular-box-shaped court with at least one transparent wall and a goal structure at each end, the goals occupying the entire length of the end walls and projecting from the rectangular-box-shape.

12 Claims, 3 Drawing Sheets

SPORTS INSTALLATION FOR THE PRACTICE OF A GAME KNOWN AS HIT BALL

DESCRIPTION

The present invention relates to a sports installation for the practice of a sport, or game, called Hit Ball. In this game two teams play a match in which the players of each team must hit the ball with their upper limbs in an attempt to direct it into the opponents' goal.

The characteristics of Hit Ball are described in a publication entitled "Hit Ball", authored by the inventor, edited by Cardue S.n.c., Turin, Italy and in other subsequent publications such as the rules of play adopted by the Italian Hit Ball Federation and the text "Hit Ball: La rivincita dello sport" filed at SIAE: Italian Association of Authors and Editors, also by the inventor. The characteristics of this game will not, therefore, be described below in detail except in so far as they are necessary for the description and the understanding of the present invention. The main characteristics of the game in question are as follows:

- the aim is to hit the ball with the upper limbs to direct it towards the opponents' goal;
- rebounds from the walls or combinations of rebounds are allowed;
- it is allowed to hit the ball with any part of the body (except for the final strike which concludes each "action");
- the goals are of considerably larger dimensions than conventional ones and are defended by a line of defenders (three) instead of a goal keeper;
- very rapid play ("short actions");
- continuity of play (the ball cannot leave the court).

At present this game is played mainly in school gymnasia with obvious disadvantages given the inadequacy of such installations, particularly with regard to the need for the walls to enable the ball to rebound in a regular manner and the possibility of spectators for matches.

Figure 1:
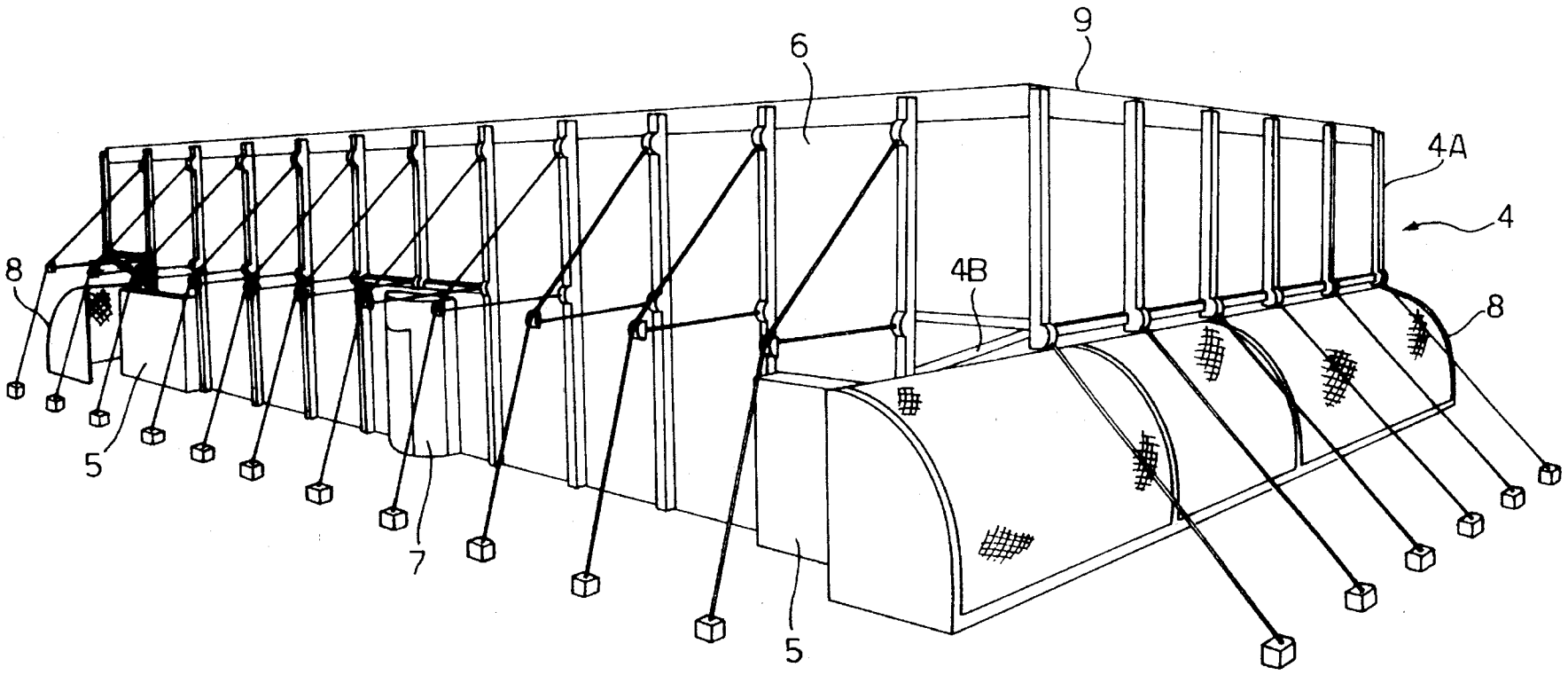
Figure 2:
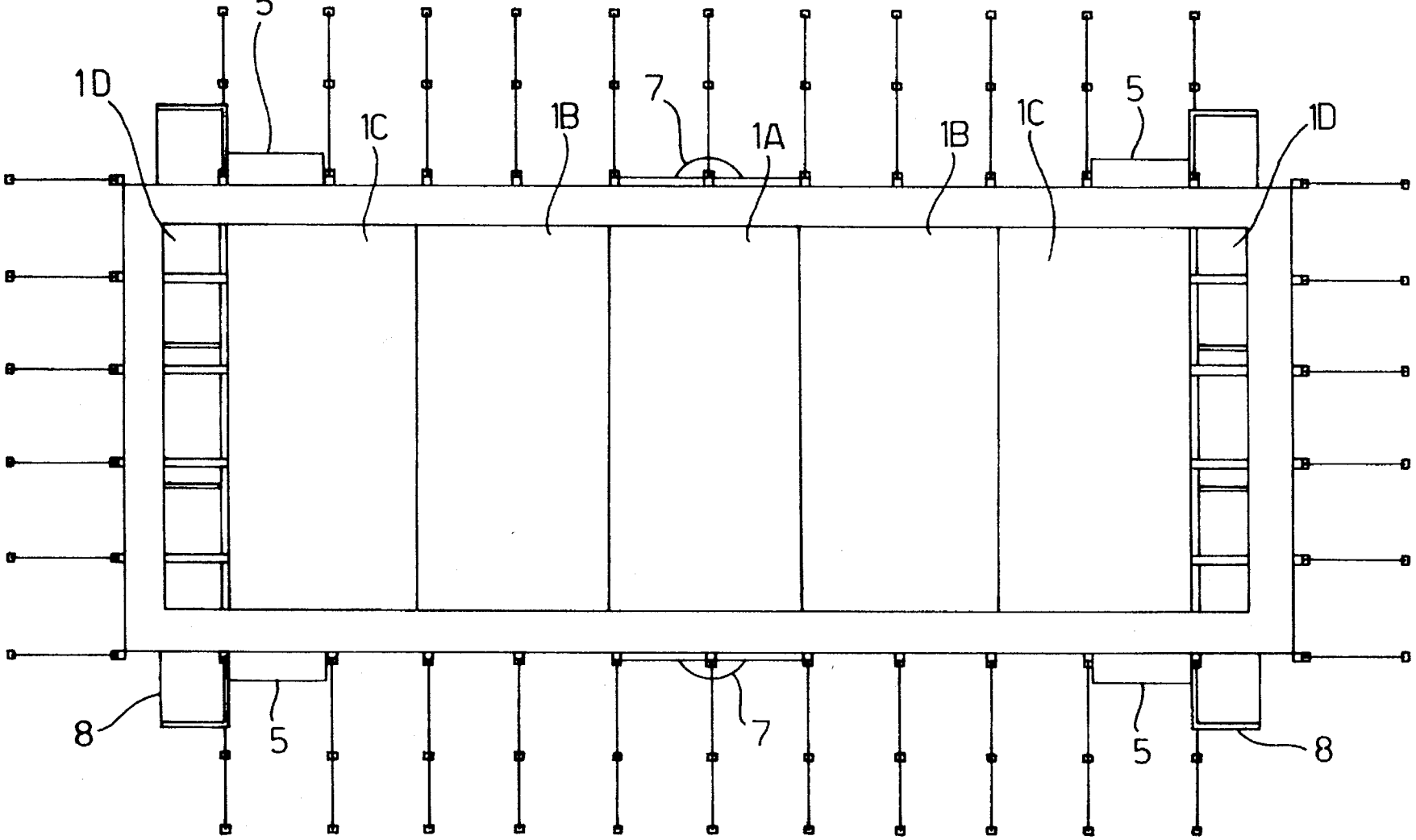
Figure 3:
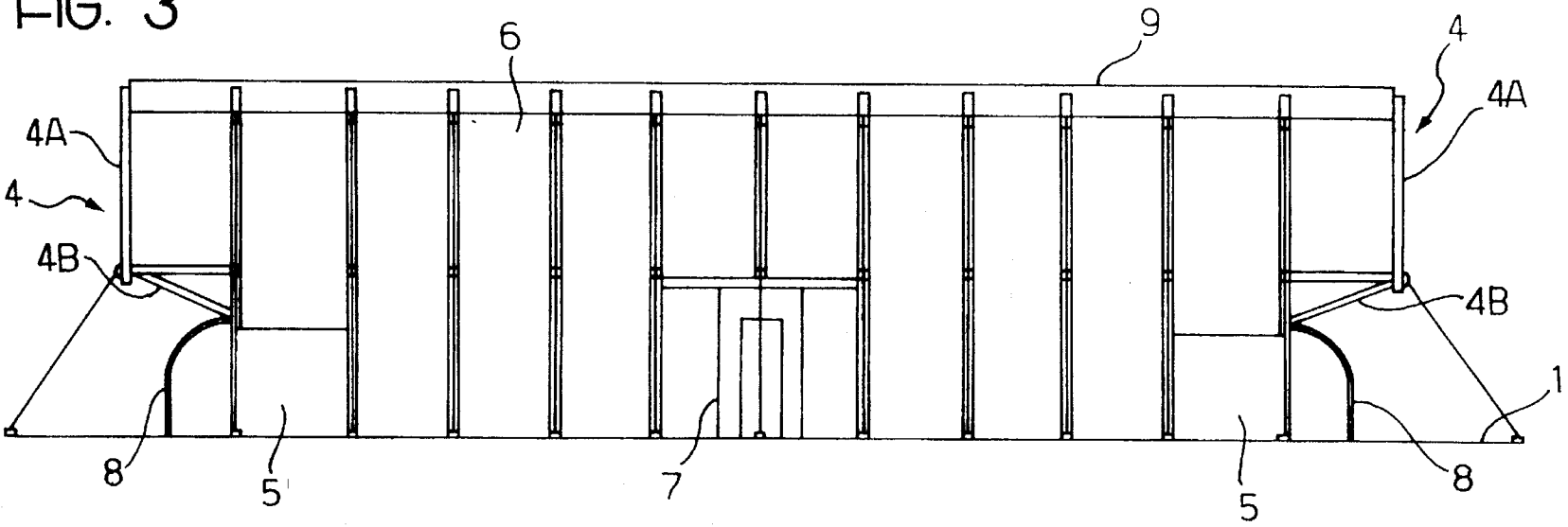
Figure 4:
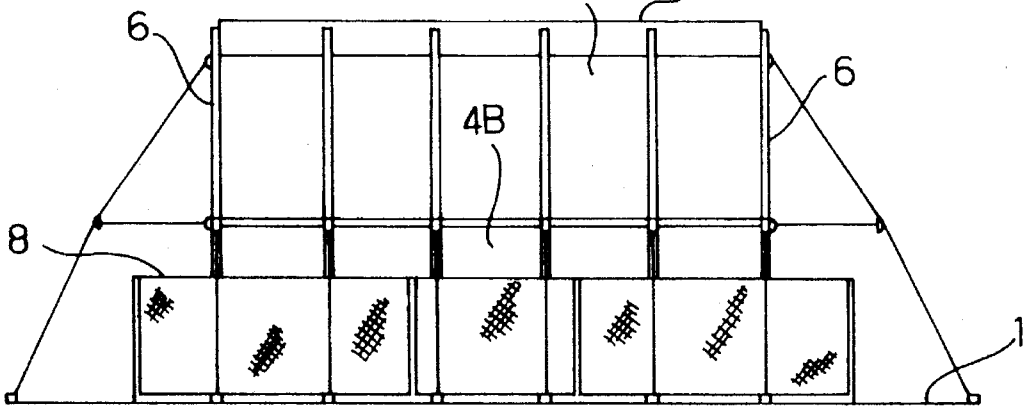

The object of the present invention is to provide a sports installation which enables all the problems indicated above to be solved satisfactorily. According to the present invention, this object is achieved by virtue of a sports installation having the characteristics indicated in the claims which follow the present description. Further advantages and characteristics of the present invention will become apparent from the detailed description which follows, given with the aid of the appended drawings, provided purely by way of non-limitative example, in which:

FIG. 1 is a schematic perspective view of an installation according to the present invention, FIG. 2 is a schematic plan view of the installation of FIG. 1, and FIGS. 3 and 4 are two schematic side views of the installation of FIG. 1 at two different angles.

The present invention, shown in FIGS. 1 to 4, thus consists of a sports installation, or playing area, constructed on a flat surface 1, for example of parquet, of rectangular-box-shape with goals 8 projecting outwardly from the two ends 4 of the court. The floor 1 of the court is divided by lines of different colours into seven separate zones: one neutral, central zone 1A, two attack zones 1B, two defence zones 1C and two goal zones 1D. The ceiling may be open or covered, for example, by an elastic net 9 (not shown in FIG. 4 for clarity) reinforced by metal support bars extending across the width of the installation. The walls of the installation are characterised in that they include at least one transparent portion, for example one or both side walls 6 may be completely transparent, for allowing the public to attend matches in a satisfactory manner. In line with the half-way, or centre, line of the court, there are two protected, transparent boxes or cabins 7 occupied by two referees. Over these are a scoreboard and a clock (not shown). At the intersections of the side walls 6 with the goal lines these walls 6 have padded matting 5 (also named protective posts) for protecting the players from collision with the wall portions adjacent the goals 8.

The lower parts of the end walls 4 of the court are occupied by the goals 8 which extend the entire width of the court and are characterised in that they project outside the rectangular-box-shape. The upper edges of the goals 8 are formed by padded cross-members to ensure the safety of the players. The end walls 4 have two re-entrant portions 4A, also projecting outside the rectangular-box-shape, located above the goals 8 with an inclined lower flat surface 4B which gives the ball a longer rebound time while at the same time returning it securely into the playing area. The net of the goals 8 is of elastic material so that the ball returns quickly into play. A slide surface (not shown) may be provided along the goal line for the lower ends of protective posts 5 (usable during practice to reduce the width of the goals 8) which may normally be housed in matting casings during official matches.

In the four corners of the goals 8 (in the rear portions) are four openings for the entry and exit of players, these being formed by the fact that each goal structure 8 extends beyond the side walls 6 of the installation. Along one of the two side walls 6 (in the attack zone 1C) there may, for example, be two further entrances (not shown) for replacements during play. In a currently preferred embodiment, the installation of the present invention has a length of 20 meters and a width of 10 meters with the five zones 1A to 1C having an equal span of 4 meters, and the zones 1D (or goals) having a span of 1.5 meter.

What is claimed is:

1. A sports installation for the practice of a team game called Hit Ball, said installation comprising a wall structure including two end walls and two side walls with substantially smooth inner surfaces defining a substantially rectangular-box-shaped playing space, said end walls each defining a goal in its lower part extending the full length of said wall.

2. An installation as claimed in claim 1, wherein at least one of said walls includes a transparent portion.

3. An installation as claimed in claim 2, wherein each of said two side walls is transparent.

4. An installation as claimed in claim 1, wherein each side wall includes a transparent cabin for a referee located centrally thereof.

5. An installation as claimed in claim 1, including a ceiling for retaining a ball within said installation in play.

6. An installation as claimed in claim 5, wherein said ceiling comprises an elastic net.

7. An installation as claimed in claim 1, wherein said side walls have regions adjacent said goals which are padded for the safety of the players.

8. An installation as claimed in claim 1, wherein each said goal is further defined by a structure located on the outer side of the respective said end wall relative to said playing space and extending laterally beyond at least one end of said end wall so as to define an entrance and exit region for said playing space.

9. An installation as claimed in claim 1, wherein each said end wall includes a horizontal cross-member defining an upper edge of said goal, which cross-member is padded and wherein each said goal is further defined by a structure located on the outer side of the respective said end wall relative to said playing space, which structure includes an elastic net.

10. An installation as claimed in claim 1, wherein said installation has a floor which is divided into seven zones by lines parallel to said walls.

11. A sports installation for the practice of a team game called Hit Ball, said installation comprising a wall structure including two end walls and two side walls with substantially smooth inner surfaces defining a substantially rectangular-box-shaped playing space, said end walls each defining a goal in its lower part extending the full length of said wall, wherein each said end wall includes a re-entrant portion of said end wall located above the respective said goal.

12. An installation as claimed in claim 11, wherein each said end wall includes a horizontal cross-member defining an upper edge of the respective said goal and wherein each said end wall has a first upper, vertical portion and a second lower, inclined portion connecting said upper portion to said cross-member of the respective said goal.

* * * * *